US007261439B2

(12) United States Patent
Sormani et al.

(10) Patent No.: US 7,261,439 B2
(45) Date of Patent: Aug. 28, 2007

(54) ILLUMINATION SYSTEM

(75) Inventors: Joseph Ludovicus Antonius Maria Sormani, Eindhoven (NL); Johannes Petrus Maria Ansems, Eindhoven (NL); Leonardus Urbanus Emile Konings, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 54 days.

(21) Appl. No.: 10/521,857

(22) PCT Filed: Jun. 26, 2003

(86) PCT No.: PCT/IB03/02811

§ 371 (c)(1),
(2), (4) Date: Jan. 21, 2005

(87) PCT Pub. No.: WO2004/015329

PCT Pub. Date: Feb. 19, 2004

(65) Prior Publication Data

US 2006/0039157 A1 Feb. 23, 2006

(30) Foreign Application Priority Data

Jul. 26, 2002 (EP) ..... 02078072

(51) Int. Cl.
*F21V 7/06* (2006.01)

(52) U.S. Cl. ..... 362/297; 362/300; 362/517; 362/518; 362/346; 362/347

(58) Field of Classification Search ..... 362/296, 362/297, 304, 341, 346, 347, 516, 518, 545, 362/555, 800, 300
See application file for complete search history.

(56) References Cited

U.S. PATENT DOCUMENTS 1,359,789 A * 11/1920 Brown ..... 362/214
3,176,124 A * 3/1965 Cibie ..... 362/217

(Continued)

FOREIGN PATENT DOCUMENTS

DE 20206833 U1 4/2002

*Primary Examiner*—Thomas M. Sember

(57) ABSTRACT

The invention relates to a road illumination system for forming a low beam in traffic applications comprising a light source and a reflecting surface formed by a multiplicity of reflector segments arranged around a central optical axis. According to the invention, the light source emits light over an angle of at most 180° in a direction facing away from the intersection of the central optical axis and the reflecting surface and the reflector segments are parabolically-shaped and have a segment optical axis parallel to the central optical axis, while the reflector segments are positioned such that the segment optical axis substantially intersects with an edge of the light source. Preferably, the illumination system is provided on poles (5, 5', . . . ) or on a crash barrier adjacent the traffic lanes 1. Alternatively, the illumination system is a vehicle headlamp. Preferably, the light source (13) is a (white) lightemitting diode.

14 Claims, 7 Drawing Sheets

U.S. PATENT DOCUMENTS 4,234,912 A * 11/1980 Barnes et al. ..... 362/145
4,520,433 A * 5/1985 Kosmatka ..... 362/516
4,694,382 A * 9/1987 Sales ..... 362/346
4,924,359 A * 5/1990 Lindae et al. ..... 362/346
5,361,193 A 11/1994 Nino
5,506,471 A * 4/1996 Kosmatka et al. ..... 313/635
5,725,298 A * 3/1998 Kalze et al. ..... 362/214
6,283,623 B1 * 9/2001 Chinniah et al. ..... 362/511
6,328,463 B1 * 12/2001 Okubo ..... 362/518
6,398,399 B1 * 6/2002 Neophytou ..... 362/576
6,406,172 B1 * 6/2002 Harbers et al. ..... 362/544
7,029,151 B2 * 4/2006 Strazzanti ..... 362/467

* cited by examiner

ILLUMINATION SYSTEM

The invention relates to an illumination system for forming a low beam in traffic applications comprising a light source and a reflecting surface formed by a multiplicity of reflector segments arranged around a central optical axis.

In addition, the invention relates to a road illumination system positioned beside a traffic route comprising such an illumination system.

The invention further relates to a vehicle headlamp comprising such an illumination system.

In the luminaire art, control of reflected energy has been carried out in various ways utilizing various types of light sources combined with various forms of (parabolic) reflecting surfaces. In automobile design there is a trend in streamlining the shape of the vehicle in order to satisfy requirements of high speed in combination with efficient fuel consumption. Such trend results in the front faces of automobiles to incline towards the horizontal plane necessitating the shape and the height of headlights to be adapted accordingly. As another trend, small metal halide lamps have attracted attention as light sources for such headlights.

For the application of lamps in vehicle headlamps, requirements for automotive passing beam patterns have been laid down (e.g. for a person skilled in the art known as E/ECE/324 and E/ECE/TRANS505). These legal requirements prescribe, amongst others, the creation of a relatively sharp so-called cut-off between the illuminated area and the glare area of the light beam emitted by the vehicle headlamp measured at a certain distance of the vehicle. In fact, the requirements prescribe point/regions just above and below said cut-off. For effectively reducing glare the light source and the reflector have to be configured in combination.

Illumination systems of the kind mentioned in the opening paragraph are known in the art. A vehicle headlamp comprising such an illumination system is known from U.S. Pat. No. 5,361,193. The known vehicle headlamp comprises as light source a discharge lamp generating an arc disposed along an optical axis and comprises a reflecting surface comprising three reflecting sectors arranged around the optical axis. The reflecting sectors consist of two paraboloid-of-revolution sectors and one additional especially-shaped sector formed as a collection of intersecting lines obtained by cutting an imaginary paraboloid of revolution.

A disadvantage of the known illumination system is that the cut-off between the illuminated area and the glare area of the light beam leaves is not as sharp as desired.

It is an object of the invention to eliminate the above disadvantage wholly or partly. According to the invention, an illumination system of the kind mentioned in the opening paragraph is for this purpose characterized in that the light source in operation emits light over an angle of at most 180.degree. in a direction facing away from the intersection of the central optical axis and the reflecting surface, and in that each of the reflector segments is parabolically-shaped and has a segment optical axis parallel to the central optical axis, while each reflector segment is positioned such that the segment optical axis substantially intersects with an edge of the light source.

By applying a light source that emits light over an angle of at most 180.degree., light from the light source is emitted in a forward direction only. To visualize the manner in which light is emitted by the light source, an imaginary plane is projected perpendicular to the central optical axis of the illumination system. This imaginary plane intersects the central optical axis at the location of the focus point of an imaginary reflector formed by the parabolically-shaped reflector segments in a situation in which the optical axes of the reflector segments would coincide with the central optical axis. In the described situation, the emission window of the light source is located in the imaginary plane and light is emitted from the emission window at one side of the imaginary plane only. No light is emitted by the light source at the backside of the imaginary plane. According to the invention, light from the light source is emitted only in the forward direction and reflected by the parabolically-shaped reflector segments which are positioned such that the segment optical axis substantially intersects with an edge of the light source. No light is directed in the backwards direction and reflected by the more central parts of the parabolically-shaped reflector segments. The inventors have had the insight that by applying a light source emitting light in half a hemisphere only in combination with the positioning of each reflector segment such that the segment optical axis substantially intersects with an edge of the light source, a sharp cut-off is obtained between the illuminated area and the glare area of the light beam emitted by the illumination system.

In the description and claims of this invention the wording "parabolically-shaped" reflector segments also includes faceted reflector segments.

A preferred embodiment of the illumination system according to the invention is characterized in that the light source is positioned substantially below a horizontal plane including the central optical axis. Light emitted by a light source according to this embodiment of the invention can after reflection on a reflector segment give rise to a light beam parallel to the central optical axis (this is the case for a portion of the light source which coincides with the central axis) or to a light beam which eventually intersects the horizontal plane (light is directed downwards to a surface of the road) but can not give rise to light in the glare area above the cut-off.

Another preferred embodiment of the illumination system according to the invention is characterized in that one edge of the light source coincides substantially with the central optical axis. In this embodiment the light source is positioned below a horizontal plane including the central optical axis whereas one edge of the light source lies in the horizontal plan. Light emitted by a light source according to this embodiment of the invention can after reflection on a reflector segment give rise to a light beam parallel to the central optical axis or to a light beam which eventually intersects the horizontal plane (light is directed downwards) but not give rise to light in the glare area above the cut-off.

A preferred embodiment of the illumination system according to the invention is characterized in that opposite reflector segments are positioned such that the optical axes of the reflector segments coincide with each other.

Another preferred embodiment of the illumination system according to the invention is characterized in that the number of reflector segments is dividable by four. Preferably, the number of reflector segments is four, eight or twelve.

A preferred embodiment of the illumination system according to the invention is characterized in that the reflector segments reflect light according to total internal reflection. The reflectivity of a reflector which operates according to the principle of total internal reflection (TIR) is more efficient because no light is lost upon reflection as compared to a reflector in which reflection is broad about by reflecting against a reflecting metal or reflecting metal-like layer on a substrate.

Preferably, the light source is a light-emitting diode (LED) or is an exit window of an optical fiber or a bundle of optical fibers. Light from such light sources is generally emitted over an angle of at most 180.degree., the intensity distribution may, by way of example, be Lambertian around the central axis of the reflecting surface. LED's and optical fibres emit light in half a hemisphere only, while the light distribution of other light sources with a coil or with an arc is, in general, a torus-like shape.

The invention will now be explained in more detail with reference to a number of embodiments and a drawing, in which:

The Figures are purely diagrammatic and not drawn true to scale. Some dimensions are particularly strongly exaggerated for reasons of clarity. Equivalent components have been given the same reference numerals as much as possible in the Figures.

FIG. 5 shows a front view of an alternative embodiment of the illumination system according to the invention where the reflecting surface comprises twelve parabolically-shaped reflector segments.

FIG. 6 shows a perspective view of the illumination system according to the invention where the reflecting surface comprises eight parabolically-shaped reflector segments.

FIG. 7 is a schematic of an alternative embodiment of the illumination system according to the invention where the light source is an exit window of an optical fiber or bundle of optical fibers.

Figure 1:
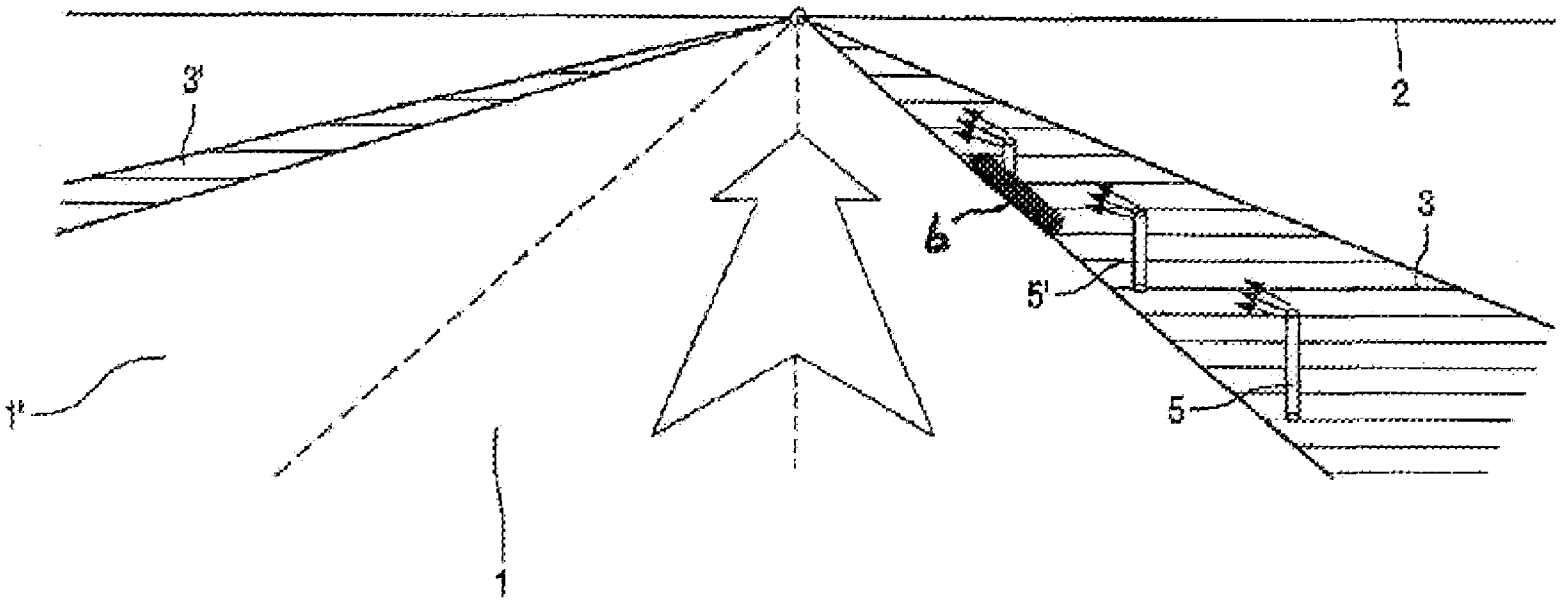
FIG. 1 shows a perspective view of a part of a traffic road provided with an embodiment of the illumination system according to the invention.

FIG. 1 diagrammatically shows a perspective view of a part of a traffic road provided with an embodiment of the illumination system according to the invention. In the example of FIG. 1, the road is divided in two lanes 1, 1' each with an adjacent (grass) verge 3, 3' and converging towards the horizon 2. The travel direction of a vehicle on one of the lanes 1 is indicated by a large arrow. The situation in FIG. 1 refers to a right-lane system; in a left-lane system, the situation is similar but mirrored. The illumination system is provided on poles 5, 5', . . . at the sides of the traffic route, in the example in the verges 3, 3' adjacent the traffic lanes 1, 1'. The poles 5, 5', . . . are shown in one of the verges 3 only. In alternative embodiment of the illumination system poles are provided for illuminating the opposite lane. In a further alternative embodiment the illumination system is provided on a crash barrier 6.

The poles 5, 5', . . . are of moderate height (typically at the same height as the headlights of a vehicle). In operation, light is emitted by the illumination system in the driving direction. In general, the poles 5, 5', . . . direct the light in the same direction as the headlights of the vehicle (the direction of the light is indicated as the small arrows emerging from each of the poles 5, 5', . . . ). An aim of the illumination system according to the invention is to increase the visibility of small objects on the road. The illumination system is configured such that projecting light on the opposite lane is largely avoided, because that will decrease the contrast with which the small objects are visible on that lane. In principle, it is not allowed that light from the illumination system reaches the eye of the driver on the opposing lane. This calls for a beam with a sharp cut-off near the centre line of the road lanes 1, 1' and to avoid unnecessary loss of light or light pollution, also a sharp cut-off near the horizon 2.

Figure 2A:
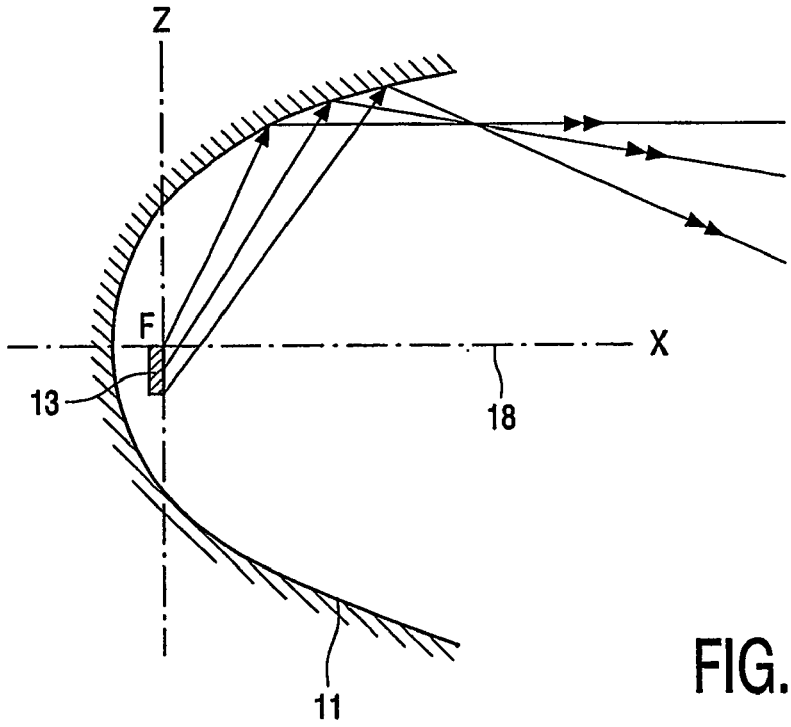
FIG. 2A shows a cross-section in the xz-plane of a light source positioned in a parabolically-shaped reflecting surface.
Figure 2B:
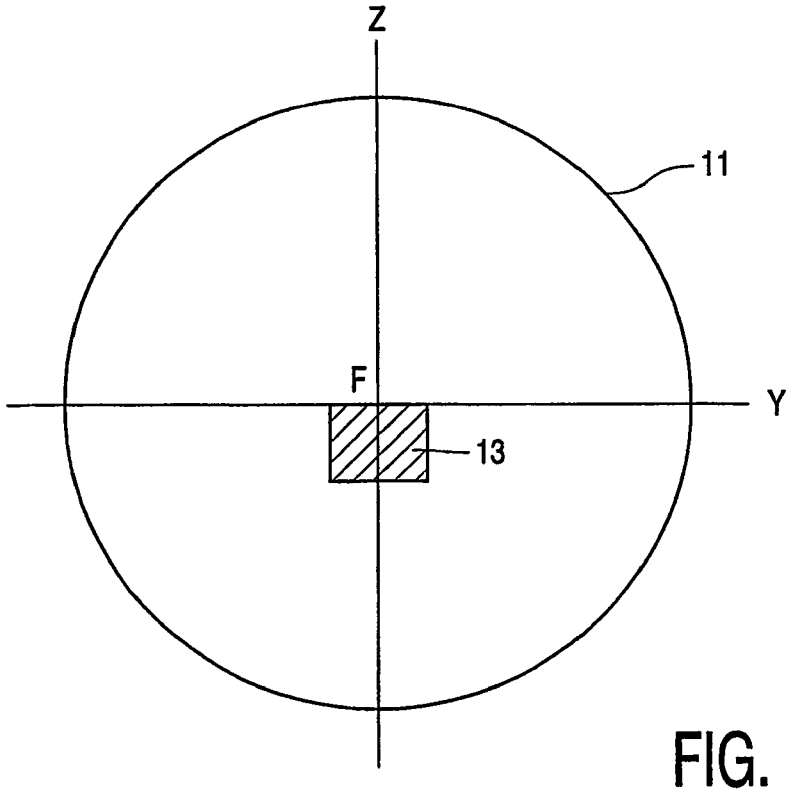
FIG. 2B shows a cross-section in the yz-plane of the light source positioned in the a parabolically-shaped reflecting surface of FIG. 2A.

FIG. 2A shows a cross-section in the xz-plane of a light source positioned in a parabolically-shaped reflecting surface 11. FIG. 2B shows a cross-section in the corresponding yz-plane. The xy-plane forms the horizontal plane; the z-direction is the vertical direction; the x-direction forms the central optical axis 18 of the illumination system coinciding with the direction in which the light is emitted by the illumination system. With respect to the yz-plane, the light source 13 is positioned in the focal point (or focus) F of the reflecting surface 11. In the situation of FIGS. 2A and 2B, an upper edge of the light source 13 touches the horizontal xy-plane including the central optical axis 18. Light rays emerging from the light source and reflected by the reflecting surface are indicated with arrows in FIG. 2A. In the preferred situation, light emitted by the light source 13 can after reflection on the reflecting surface 11 give rise to a light beam parallel to the central optical axis 18 or to a light beam which eventually intersects the central optical axis 18 and/or the horizontal xy-plane. In such a situation, light emitted by the light source 13 and reflected by the reflecting surface 11 can not contribute to the glare area above the cut-off.

Figure 3C:
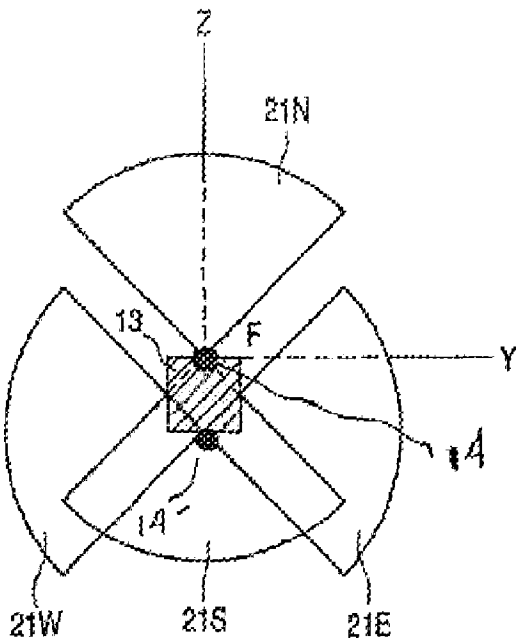
FIG. 3C shows a front view of the illumination system according to the invention where the reflecting surface comprises four parabolically-shaped reflector segments.

The reflecting surface does not form a continuous parabolically-shaped reflector surface but is divided into a multiplicity of reflector segments. FIG. 3A shows very schematically a front view of the illumination system according to the invention where the reflecting surface comprises two parabolically-shaped reflector segments 21N and 21S. For the sake of clarity only parts of the reflector segments are shown. The reflector segment with reference numeral 21N is placed in front of the positive z-axis and will also be referred to the "north" reflector segment 21N. The reflector segment with reference numeral 21S is placed in front of the negative z-axis and will also be referred to the "south" reflector segment 21S. The north and south parabolically-shaped reflector segments 21N, 21S have been positioned such that the segment optical axis 14 (here projected as a point in the ZY plane of the drawing) intersects the upper edge of the light source 13. Because said upper edge of the light source 13 lies on the y-axis, the segment optical axis for the north and south reflector segments coincides with the central optical axis of the reflecting surface. By placing the north and south reflector segments 21N, 21S along the upper edge of the light source 13, the desired sharp cut-off between the illuminated area and the glare area of the light beam is realized.

Figure 3B:
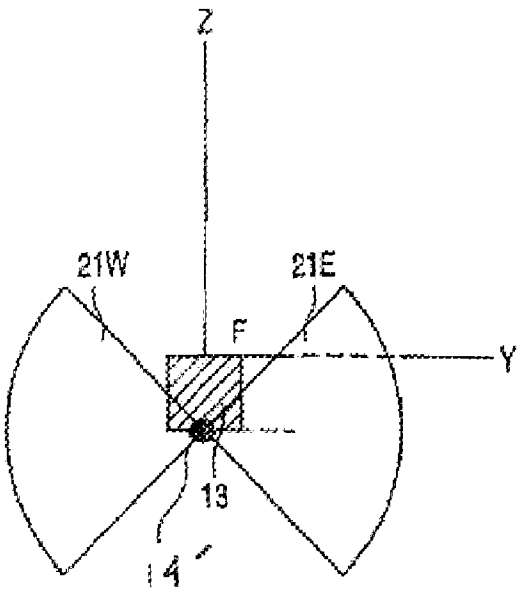
FIG. 3B shows a front view of the illumination system according to the invention where the reflecting surface comprises two further parabolically-shaped reflector segments.
Figure 3A:
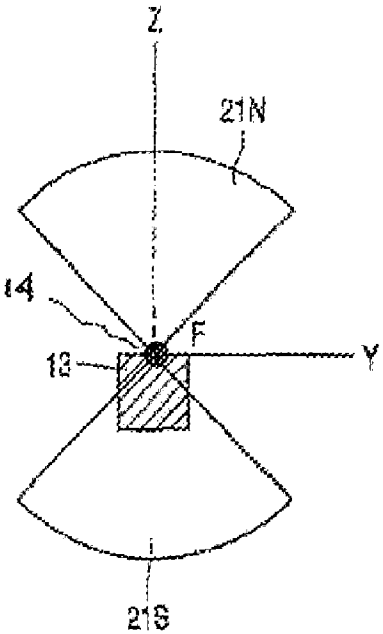
FIG. 3A shows a front view of the illumination system according to the invention where the reflecting surface comprises two parabolically-shaped reflector segments.

FIG. 3B shows a front view of the illumination system according to the invention where the reflecting surface comprises two further parabolically-shaped reflector segments 21E and 21W. For the sake of clarity only parts of the reflector segments are shown. The reflector segment with reference numeral 21E is placed in front of the positive y-axis and will also be referred to the "east" reflector segment 21E. The reflector segment with reference numeral 21W is placed in front of the negative y-axis and will also be referred to the "west" reflector segment 21W. The east and west parabolically-shaped reflector segments 21E, 21W have been positioned such that the segment optical axis 14' (here projected as a point in the ZY plane of the drawing) intersects the lower edge of the light source 13. By placing the east and west reflector segments 21E, 21W along the lower edge of the light source 13, the desired sharp cut-off between the illuminated area and the glare area of the light beam is realized.

FIG. 3C shows a front view of the illumination system according to the invention where the reflecting surface comprises four parabolically-shaped reflector segments 21N, 21E, 21S and 21W. For the sake of clarity only parts of the reflector segments are shown. In FIG. 3C the situations of FIGS. 3A and 3B have been superimposed. The north and south parabolically-shaped reflector segments 21N, 21S have been positioned such that the segment optical axis 14 intersects the upper edge of the light source 13. The east and west parabolically-shaped reflector segments 21E, 21W have been positioned such that the segment optical axis 14' intersects the lower edge of the light source 13. By placing the north and south reflector segments 21N, 21S along the upper edge of the light source 13, and by placing the east and west reflector segments 21E, 21W along the lower edge of the light source 13, the desired sharp cut-off between the illuminated area and the glare area of the light beam is realized. Note with respect to FIG. 3C, that there is partly an overlap between the reflector segments and that there are holes between reflector segments.

Figure 4:
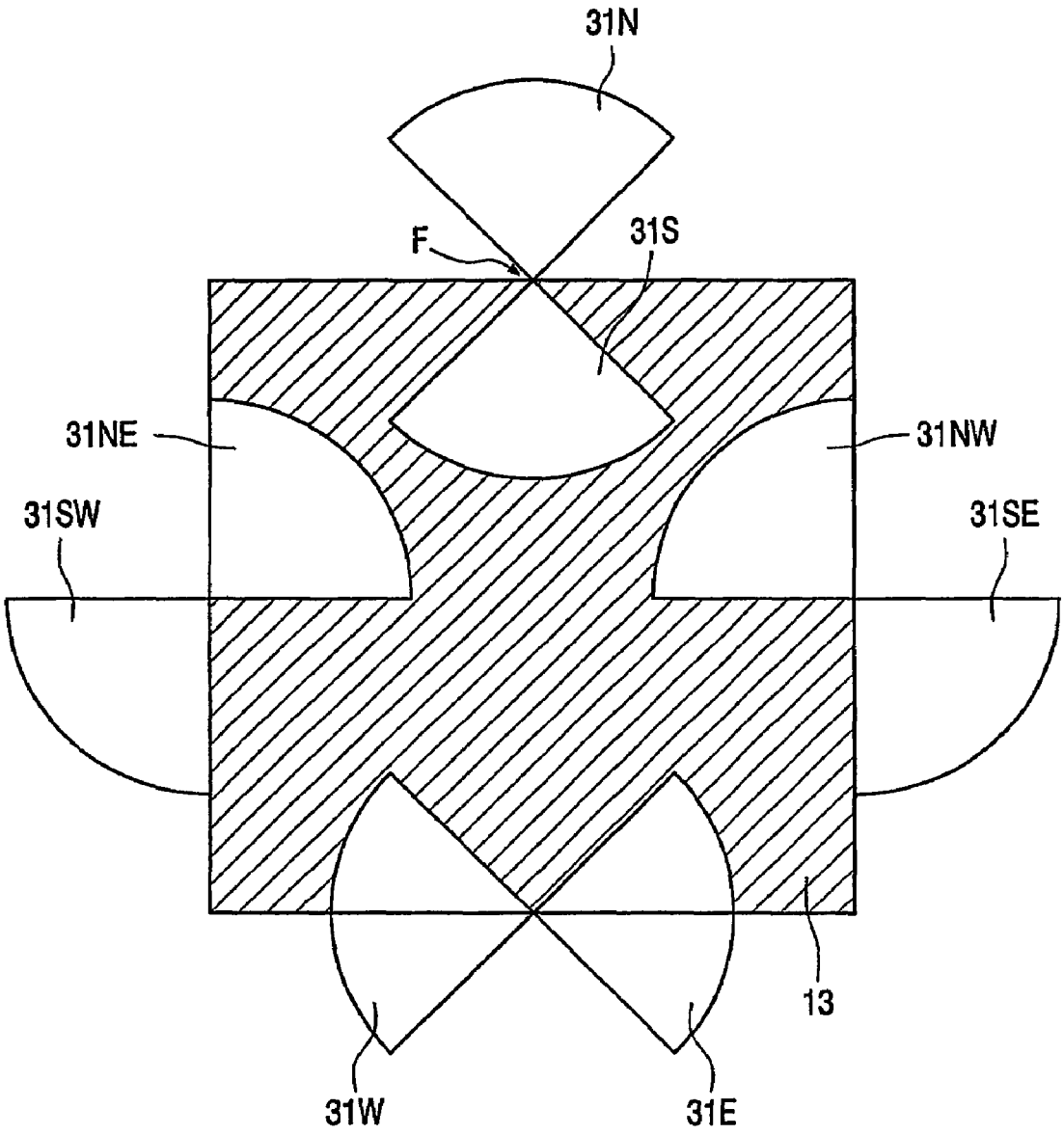
FIG. 4 shows a front view of an alternative embodiment of the illumination system according to the invention where the reflecting surface comprises eight parabolically-shaped reflector segments.

FIG. 4 shows a front view of an alternative embodiment of the illumination system according to the invention where the reflecting surface comprises eight parabolically-shaped reflector segments 31N, 31S, 31E, 31W, 31NE, 31 SW, 31NW, 31SE. The light source 13 and the focal point of the reflecting surface (see FIG. 2A) are also given. For clarity reasons only parts of the reflector segments are shown. As a general rule of thumb, the north and south reflector segments are preferably in the center of the upper edge of the light source 13, the east and west reflector segments are preferably in the center of the lower edge of the light source 13. The remaining reflector segments are positioned along the vertical edges of the light source 13, preferably, at regular intervals. With the scheme of placement as described here above, a sharp cut-off between the illuminated area and the glare area is obtained. If a modified positioning scheme is employed, a cut-off with less light above the cut-off (in the glare area) is obtained at the expense of a less steep transition between the illuminated and the not-illuminated part.

Figure 5:
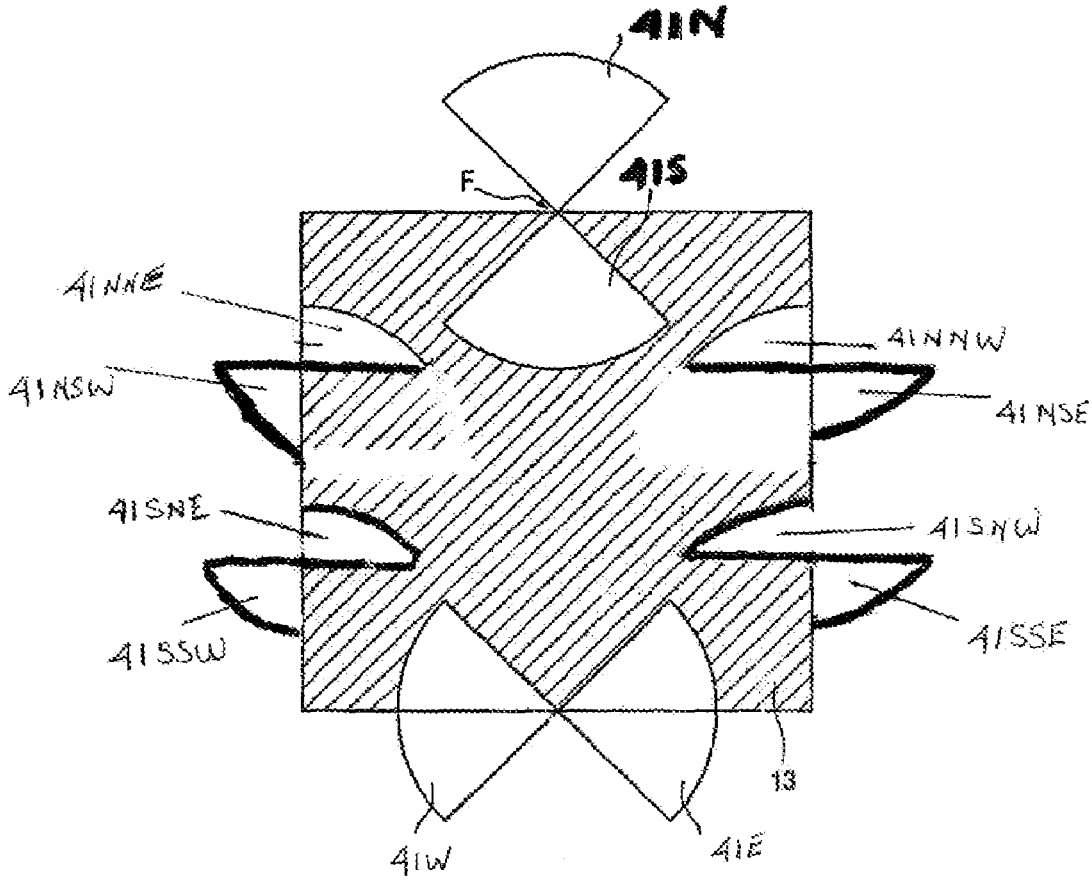

FIG. 5 shows a front view of an alternative embodiment of the illumination system according to the invention where the reflecting surface comprises twelve parabolically-shaped reflector segments 41N, 41S, 4NNE, 41NSW, 41SNE, 41SSW, 41W, 41E, 41SSE, 41SNW, 41NSE, 41NNW. The light source 13 and the focal point of the reflecting surface (see FIG. 2A) are also given. For clarity, only parts of the reflector segments are shown. As a general rule of thumb, the north and south reflector segments are preferably in the center of the upper edge of the light source 13, the east and west reflector segments are preferably in the center of the lower edge of the light source 13. The remaining eight reflector segments are positioned along the vertical edges of the light source 13, preferably, at regular intervals. With the scheme of placement as described here above, a sharp cut-off between the illuminated area and the glare area is obtained. If a modified positioning scheme is employed, a cut-off with less light above the cut-off (in the glare area) is obtained at the expense of a less steep transition between the illuminated and the not-illuminated part.

Figure 6:
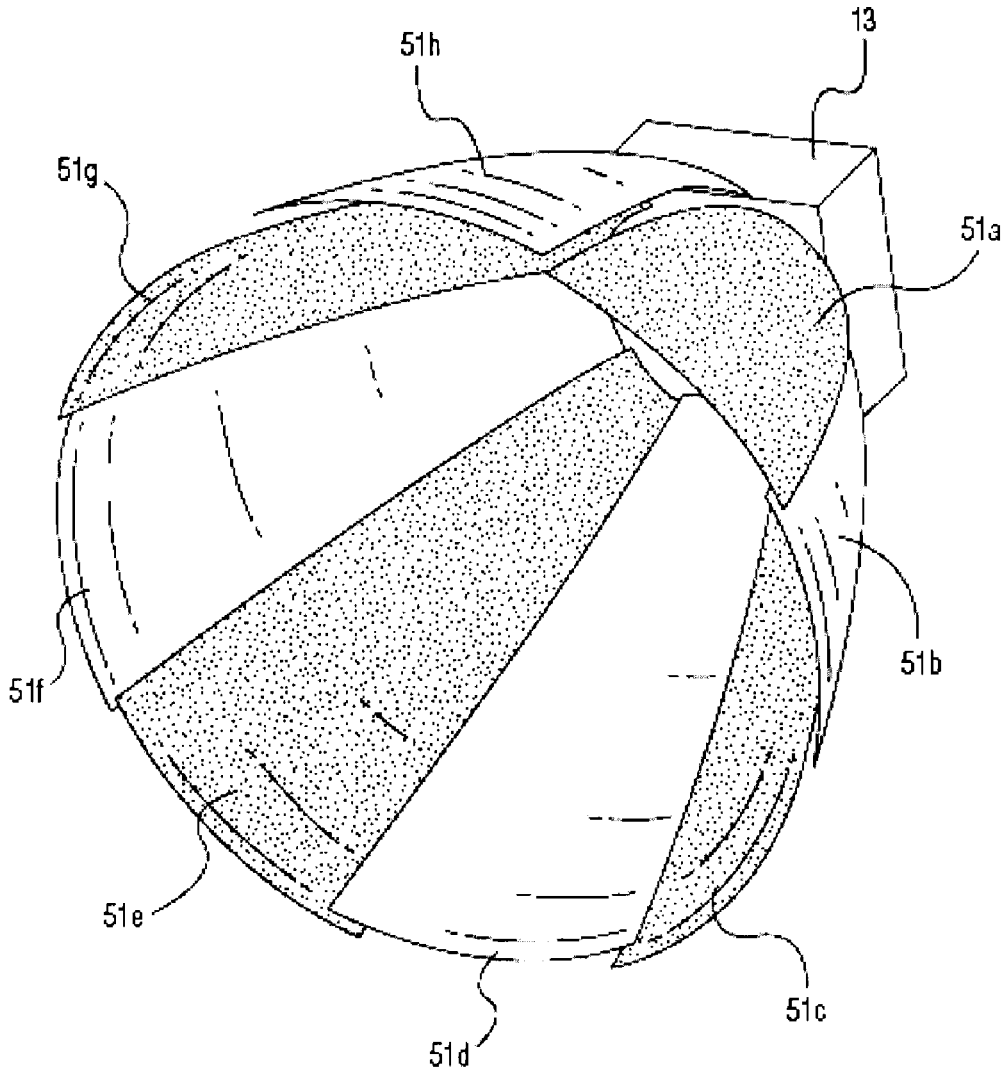

FIG. 6 shows a perspective view of the illumination system according to the invention where the reflecting surface comprises eight parabolically-shaped reflector segments 51*a*, 51*b*, 51*c*, 5 id, 51*e*, 5 if, 51*g*, 51*h*. The light source 13 is positioned in the focal point of the reflecting surface. As shown, the reflecting surface does not form a continuous parabolically-shaped reflector surface but is divided into a multiplicity of reflector segments. The parabolically shaped reflector segments have been positioned such that each segment optical axis intersects an edge of the light source 13.

In an alternative embodiment of the illumination system, the illumination system such as the illumination system shown in FIG. 6, is comprised in a vehicular headlight.

Preferably, the reflector segments of the reflect light according to total internal reflection. The reflectivity of a reflector which operates according to the principle of total internal reflection (TIR) is very efficient because no light is lost upon reflection as compared to a reflector in which reflection is broad about by reflecting against a reflecting metal or reflecting metal-like layer on a substrate.

Figure 7:
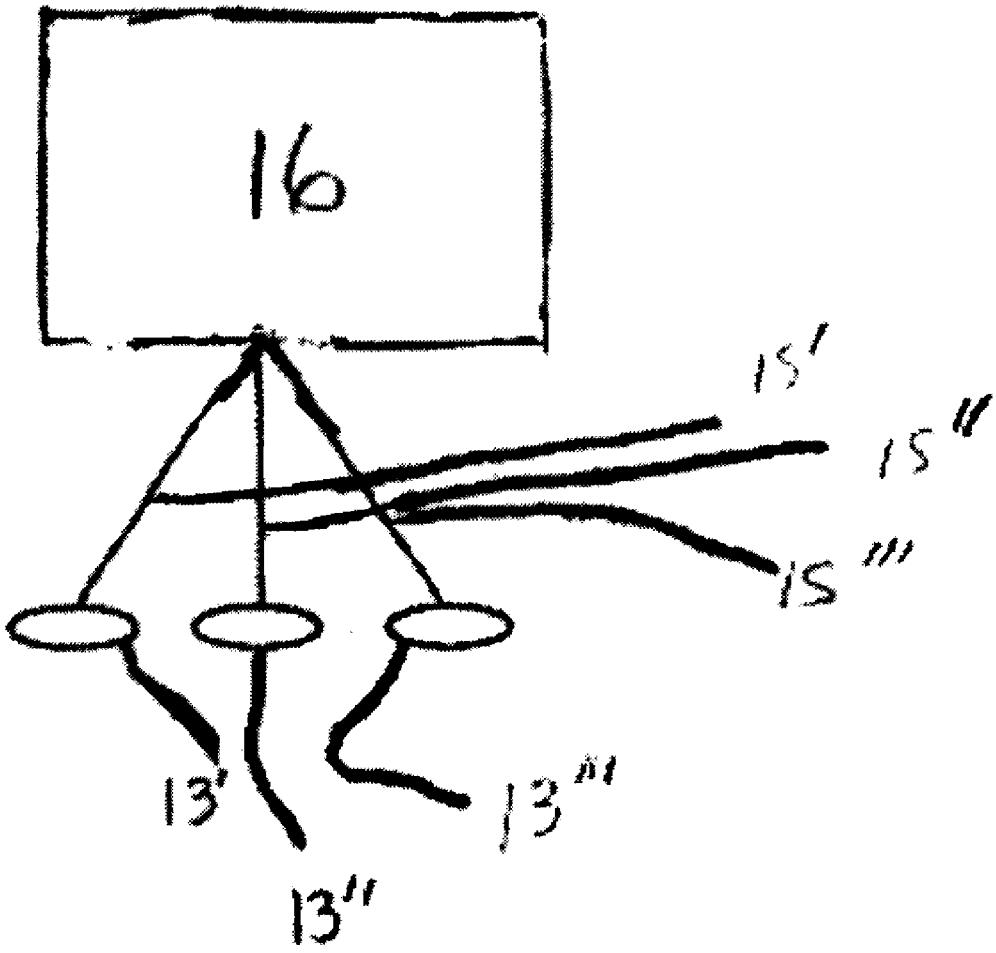

A preferred light source of the illumination system is a light-emitting diode (LED). Preferably, the LED emits in operation substantially white light. In an alternative embodiment, as shown in FIG. 7, the light source 13 in the illumination system is an exit window 13', 13", 13'" of an optical fiber or a bundle of optical fibers 15', 15", 15'". Preferably, the fiber or fibers are powered by a so-called light engine 16.

The scope of the invention is not limited to the embodiments. The invention is embodied in each new characteristic and each combination of characteristics. Any reference sign do not limit the scope of the claims. The word "comprising" does not exclude the presence of other elements or steps than those listed in a claim. Use of the word "a" or "an" preceding an element does not exclude the presence of a plurality of such elements.

The invention claimed is:

1. An illumination system for forming a low beam in traffic applications comprising a light source and a reflecting surface formed by a multiplicity of reflector segments arranged around a central optical axis, wherein the light source is positioned in a focal point of the reflecting surface, the light source having a major axis parallel to the central optical axis, the light source in operation emitting light over an angle of at most 180° in a direction facing away from the intersection of the central optical axis and the reflecting surface and toward the emission window, and in that each of the reflector segments is parabolically-shaped and has a segment optical axis parallel to the central optical axis, wherein each reflector segment is positioned such that the segment optical axis substantially intersects with an edge of the light source, such that the reflector segment optical axis aligns with the central optical axis of the reflecting surface forming a sharp cutoff between an illuminated area and a glare area of the light beam without the aid of occulting elements.

2. An illumination system as claimed in claim 1, wherein the light source is positioned substantially below a horizontal plane including the central optical axis.

3. An illumination system as claimed in claim 1, wherein one edge of the light source coincides substantially with the central optical axis.

4. An illumination system as claimed in claim 1, wherein opposite reflector segments are positioned such that the optical axes of the reflector segments coincide with each other.

5. An illumination system as claimed in claim 1, wherein the number of reflector segments is divisible by four.

6. An illumination system as claimed in claim 5, wherein the number of reflector segments is four, eight or twelve.

7. An illumination system as claimed in claim 1, wherein the reflector segments reflect light according to total internal reflection.

8. An illumination system as claimed in claim 1, wherein the light source is a light-emitting diode.

9. An illumination system as claimed in claim 1, wherein the light-emitting diode in operation substantially emits white light.

10. An illumination system as claimed in claim 1, wherein the light source is an exit window of an optical fiber or a bundle of optical fibers.

11. An illumination system as claimed in claim 1, wherein the fiber or fibers are powered by a light engine.

12. A road illumination system positioned beside a traffic route comprising an illumination system as claimed in claim 1.

13. A road illumination system as claimed in claim 12, wherein the road illumination system is provided on poles or on a crash barrier at the side of the traffic route.

14. A vehicle headlamp comprising an illumination system wherein the illumination system has a light source and a reflecting surface formed by a multiplicity of reflector segments arranged around a central optical axis, wherein the light source is positioned in a focal point of the reflecting surface, the light source having a major axis parallel to the central optical axis, the light source in operation emitting light over an angle of at most 180° in a direction facing away from the intersection of the central optical axis and the reflecting surface and toward the emission window, and in that each of the reflector segments is parabolically-shaped and has a segment optical axis parallel to the central optical axis, while wherein each reflector segment is positioned such that the segment optical axis substantially intersects with an edge of the light source, such that the reflector segment optical axis coincides aligns with the central optical axis of the reflecting surface forming a sharp cutoff between an illuminated area and a glare area of the light beam without the aid of occulting elements.

* * * * *